US008146684B2

(12) United States Patent
Cravatte

(10) Patent No.: US 8,146,684 B2
(45) **Date of Patent: *Apr. 3, 2012**

(54) CORING APPARATUS WITH SENSORS

(75) Inventor: Phillipe Cravatte, Aberdeen (GB)

(73) Assignee: Corpro Systems Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/974,445

(22) Filed: Dec. 21, 2010

(65) Prior Publication Data

US 2011/0083905 A1 Apr. 14, 2011

Related U.S. Application Data

(62) Division of application No. 12/341,466, filed on Dec. 22, 2008, now Pat. No. 7,878,269.

(30) Foreign Application Priority Data

Dec. 21, 2007 (GB) ..... 0724972.5

(51) Int. Cl.
*E21B 49/02* (2006.01)
*E21B 47/00* (2006.01)
*E21B 25/00* (2006.01)
*G01N 1/00* (2006.01)

(52) U.S. Cl. ..... 175/58; 175/44; 73/864.44; 73/152.46

(58) Field of Classification Search ..... 175/44, 175/58; 73/864.44, 152.46
See application file for complete search history.

(56) References Cited

U.S. PATENT DOCUMENTS

| | | | | |
|---|---|---|---|---|
| 3,363,703 | A | 1/1968 | Shewmake | |
| 4,499,955 | A | 2/1985 | Campbell et al. | |
| 5,417,295 | A | 5/1995 | Rao et al. | |
| 5,984,023 | A * | 11/1999 | Sharma et al. | 175/50 |
| 6,003,620 | A | 12/1999 | Sharma et al. | |
| 6,006,844 | A | 12/1999 | Puymbroeck et al. | |
| 6,220,371 | B1 * | 4/2001 | Sharma et al. | 175/50 |
| 7,665,542 | B2 | 2/2010 | Stockton | |
| 7,878,269 | B2 * | 2/2011 | Cravatte | 175/58 |
| 2002/0033281 | A1 | 3/2002 | Aumann et al. | |
| 2008/0156537 | A1 | 7/2008 | Stockton | |
| 2009/0078467 | A1 | 3/2009 | Castillo | |
| 2009/0159335 | A1 | 6/2009 | Cravatte | |
| 2010/0000108 | A1 | 1/2010 | Stockton | |
| 2011/0083905 | A1 * | 4/2011 | Cravatte | 175/239 |

FOREIGN PATENT DOCUMENTS

| | | |
|---|---|---|
| WO | 92/02707 | 2/1992 |
| WO | 2006/058377 | 6/2006 |
| WO | 2008/034174 | 3/2008 |

* cited by examiner

*Primary Examiner* — Jennifer H Gay
(74) *Attorney, Agent, or Firm* — DLA Piper LP (US)

(57) ABSTRACT

An apparatus and method obtains a sample from a subterranean formation. The coring apparatus includes an outer core barrel associated with a drill bit; an inner core barrel adapted to accept a core sample; and sensors adapted to provide data relating to downhole conditions. The sensors may be one or more sensors the output of which is indicative of entry of a core sample into the inner core barrel.

5 Claims, 3 Drawing Sheets

CORING APPARATUS WITH SENSORS

RELATED APPLICATIONS

This is a divisional of U.S. patent application Ser. No. 12/341,466 filed Dec. 22, 2008, issued as U.S. Pat. No. 7,878,269 on Feb. 1, 2011, which claims priority of United Kingdom Patent Application No. 0724972.5 filed on Dec. 21, 2007, the subject matter of which is incorporated herein by reference.

TECHNICAL FIELD

This disclosure relates to apparatus and a method for obtaining a sample, such as a core sample, from a subterranean formation such as those found in an oil and/or gas reservoir. More particularly, it relates to a method of monitoring core barrel operations and a core barrel monitoring apparatus.

BACKGROUND

Extracting core samples from subterranean formations is an important aspect of the drilling process in the oil and gas industry. The samples provide geological and geophysical data, enabling a reservoir model to be established. Core samples are typically retrieved using coring equipment, which is transported to a laboratory where tests can be conducted on the core sample. The coring equipment typically includes a core barrel provided with a drill bit on the lower end thereof. In use, the core barrel and drill bit are rotated such that the drill bit cuts into the formation and the sample to be retrieved enters into the inner bore of the core barrel within which it will be entrapped and brought to the surface of the well, at which point where it can be taken to a laboratory to be analyzed.

However, a major problem when coring is that the core sample can become jammed or can collapse in the barrel and so instead of obtaining for example a 30 meter core within a 30 meter core barrel, only a few meters of core may be obtained within the inner bore of the core barrel if it jams and accordingly that 30 meter potential core sample is lost forever.

In recent years there have been some attempts to monitor the entry of a core into the barrel and one recent prior art system for doing so is disclosed in International PCT Patent Publication No. WO2006/058377 and which uses a core sample marker (32) (or "rabbit" as such equipment is known in the industry) located inside the inner core barrel 16 (see FIG. 4). As the core enters the inner barrel (16), the core pushes the rabbit (32) upwards and such upward movement is observed by using longitudinally spaced apart length markers (36, 38) and a location sensor (34). Accordingly, the distance travelled by the rabbit (32) can be transmitted in a signal to a signal receiver at the surface of the well. However, although there is some disclosure of providing a pressure sensor, a temperature sensor and possibly a rotational sensor, the information that can be sent to the operator at the surface is substantially limited to monitoring the entry of the core sample into the inner barrel and therefore it is not possible to foresee if a jam is likely to occur with the prior art system shown in PCT Publication No. WO2006/058377. Furthermore, the core barrel apparatus shown in International PCT Publication No. WO2006/058377 suffers from the disadvantage that the rabbit (32) will inherently to some extent inhibit the entry of the core sample into the inner core barrel.

SUMMARY

I provide a coring apparatus comprising:

an outer core barrel associated with a drill bit;

an inner core barrel adapted to accept a core sample; and one or more sensors adapted to provide data relating to downhole conditions, the one or more sensors selected from the group of:

a) a strain sensor adapted to measure tension and/or compression experienced by the inner core barrel;

b) a first pressure sensor adapted to measure pressure outwith the inner barrel and a second pressure sensor adapted to measure pressure within the inner barrel;

c) a rotation sensor adapted to measure relative rotation between the inner core barrel and the outer core barrel; and d) a vibration sensor adapted to measure vibration experienced by the inner barrel.

Optionally, the coring apparatus further comprises:

e) a temperature sensor adapted to measure the downhole temperature.

Optionally, the coring apparatus comprises two of sensors a) to d) and more preferably the coring apparatus comprises three of sensors a) to d) and most preferably the coring apparatus comprises all four sensors a) to d).

Optionally, sensor a) is located on or embedded within a side wall of the inner core barrel.

The coring apparatus may comprise sensor b) and further includes an electronics housing with a lower end, wherein the inner core barrel includes a side wall and wherein the first pressure sensor is provided on the lower end of the electronics housing in fluid communication with the interior of the inner core barrel and the second pressure sensor is provided on or embedded within a side wall of the inner core barrel and is in fluid communication with the exterior of the inner core barrel.

Optionally, the coring apparatus comprises sensor c) wherein the coring apparatus includes an electronics housing and sensor c) is provided in the electronics housing.

Sensor d) may be mounted on the inner core barrel.

The coring apparatus may further comprise a data transmission means to transmit the data received from the one or more sensors to an operator at the surface. Alternatively, the apparatus comprises a data memory device capable of collecting and storing data output from the one or more sensors such that the data can be analyzed back at the surface when the coring apparatus and core sample are retrieved back to surface in order to provide information on the downhole conditions experienced when the core sample was obtained.

The coring apparatus may comprise sensor b) and further includes a pressure release mechanism operable to release pressure from within the inner core barrel if the pressure differential between the inner and outer core barrels exceeds a pre-determined level.

According to a first aspect, there is provided a method of monitoring a coring operation comprising:

providing a coring apparatus having one or more sensors associated therewith;

inserting the coring apparatus into a downhole borehole; and collecting data output from the one or more sensors and transmitting it to the surface, said data being indicative of downhole conditions, such that the operator is provided with real time data of the coring operation.

According to a second aspect, there is provided a method of gathering information about a coring operation comprising:

providing a coring apparatus having one or more sensors associated therewith and a data memory device;

inserting the coring apparatus into a downhole borehole, and collecting data output from the one or more sensors and storing it in the data memory device; and retrieving the coring apparatus and a core sample back to surface and analyzing the data stored in the data memory device to provide information on the downhole conditions experienced when the core sample was obtained.

The coring apparatus used in the methods comprises one or more sensors selected from the group consisting of:

a) a strain sensor adapted to measure tension and/or compression experienced by the inner core barrel;

b) a first pressure sensor adapted to measure pressure outwith the inner barrel and a second pressure sensor adapted to measure pressure within the inner barrel;

c) a rotation sensor adapted to measure relative rotation between the inner core barrel and the outer core barrel; and d) a vibration sensor adapted to measure vibration experienced by the inner barrel.

Typically, the apparatus further comprises a first fluid pathway therethrough, wherein the first fluid pathway is typically located in between the inner and outer core barrel. Typically, the apparatus further comprises a second fluid pathway therethrough where the second fluid pathway is typically selectively obturable, such as by means of an object dropped from the surface of the well, where the object may be a drop ball or the like. The second fluid pathway may connect the interior of the inner core barrel with the exterior of the apparatus. The first fluid pathway typically provides a pathway for fluid, such as drilling mud pumped from the surface, to carry drill debris away from the apparatus and the second fluid pathway typically provides a pathway to clear drill debris from the interior of the inner barrel. Typically, the second fluid pathway is formed through the length of the electronics housing.

BRIEF DESCRIPTION OF THE DRAWINGS

Non-limiting examples will now be described with reference to the accompanying drawings, in which.

DETAILED DESCRIPTION

Figure 1:
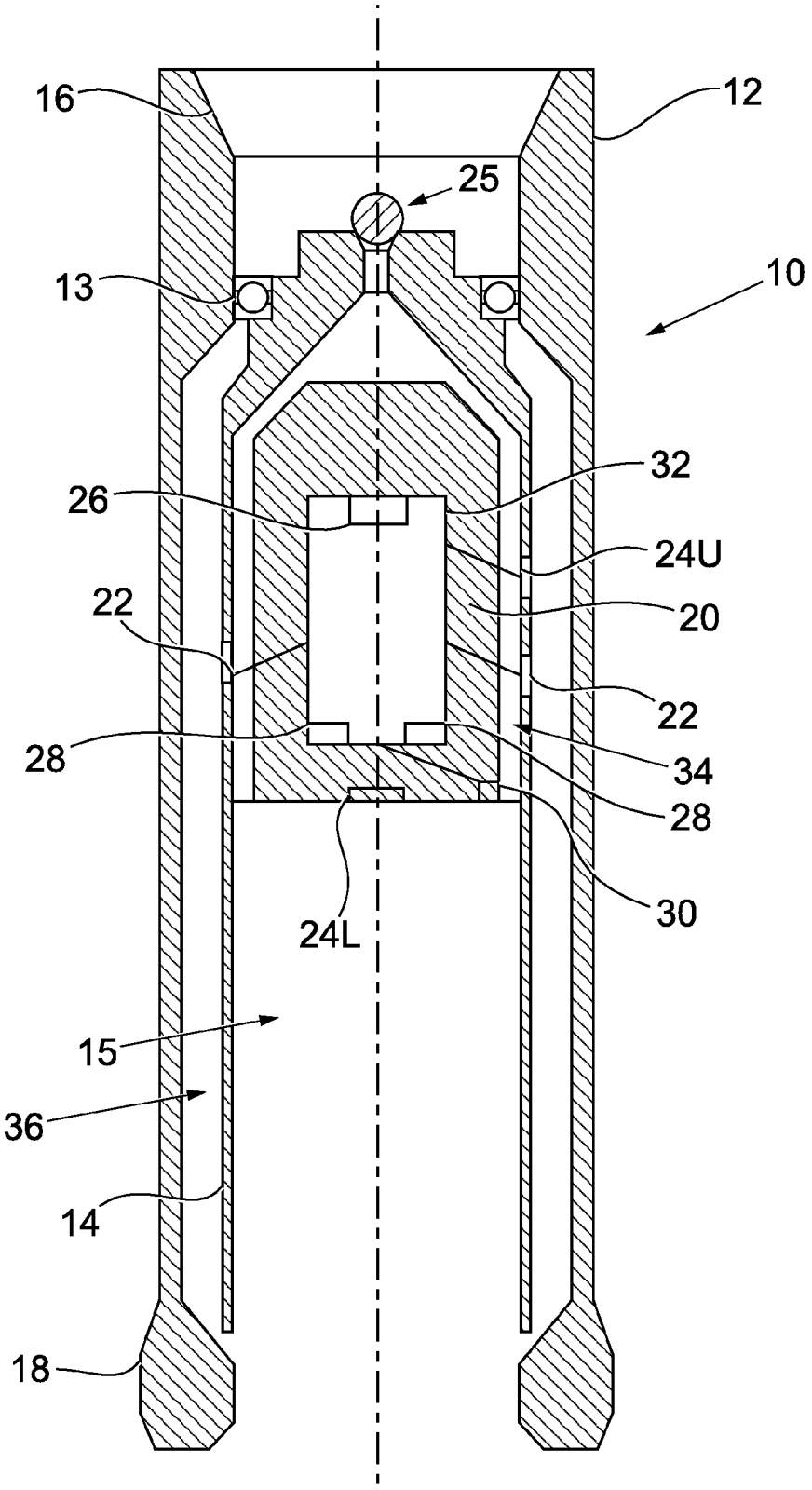
FIG. 1 is a cross-sectional schematic view of a coring apparatus.

FIG. 1 is a schematic view of a core barrel apparatus 10. The core barrel 10 comprises an outer core barrel 12 and an inner core barrel 14 which is rotatable with respect to the outer core barrel 12 via a rotatable bearing 13. The core barrel 10 comprises a threaded pin connection 16 at its uppermost end for connection to the lower end of a drillstring such that the core barrel 10 can be run into a downhole borehole on the lower end of the drillstring (not shown). The core barrel 10 further comprises a drill bit 18 located at its lowermost end for cutting into a hydrocarbon reservoir and associated surrounding formation when a core sample is desired.

The core barrel 10 furthermore comprises a number of sensors as follows:

a) Strain (Tension/Compression) Sensors

One or more strain meters 22 are located on or are preferably embedded or otherwise formed or provided in the side wall of the inner barrel 14 such that the strain meters 22 act to provide a measurement of the tension or compression experienced by the inner barrel 14. Because the inner barrel 14 is hung from the rest of the core barrel 10 by means of the rotational bearing 13, the strain meters 22 will normally be in tension. However, once the core sample (not shown) starts to enter the inner core barrel 14, the strain meters 22 will experience less tension and may even experience compression because of the friction created between the core sample and the inner surface of the inner core barrel 14; in this regard, the inner diameter of the inner core barrel is intentionally chosen to be around the same as the inner diameter of the throughbore of the drill bit 18. Accordingly, in use, the output of the strain meters 22 is indicative of entry of a core sample into the inner core barrel 14.

b) Pressure Sensors

Figure 2:
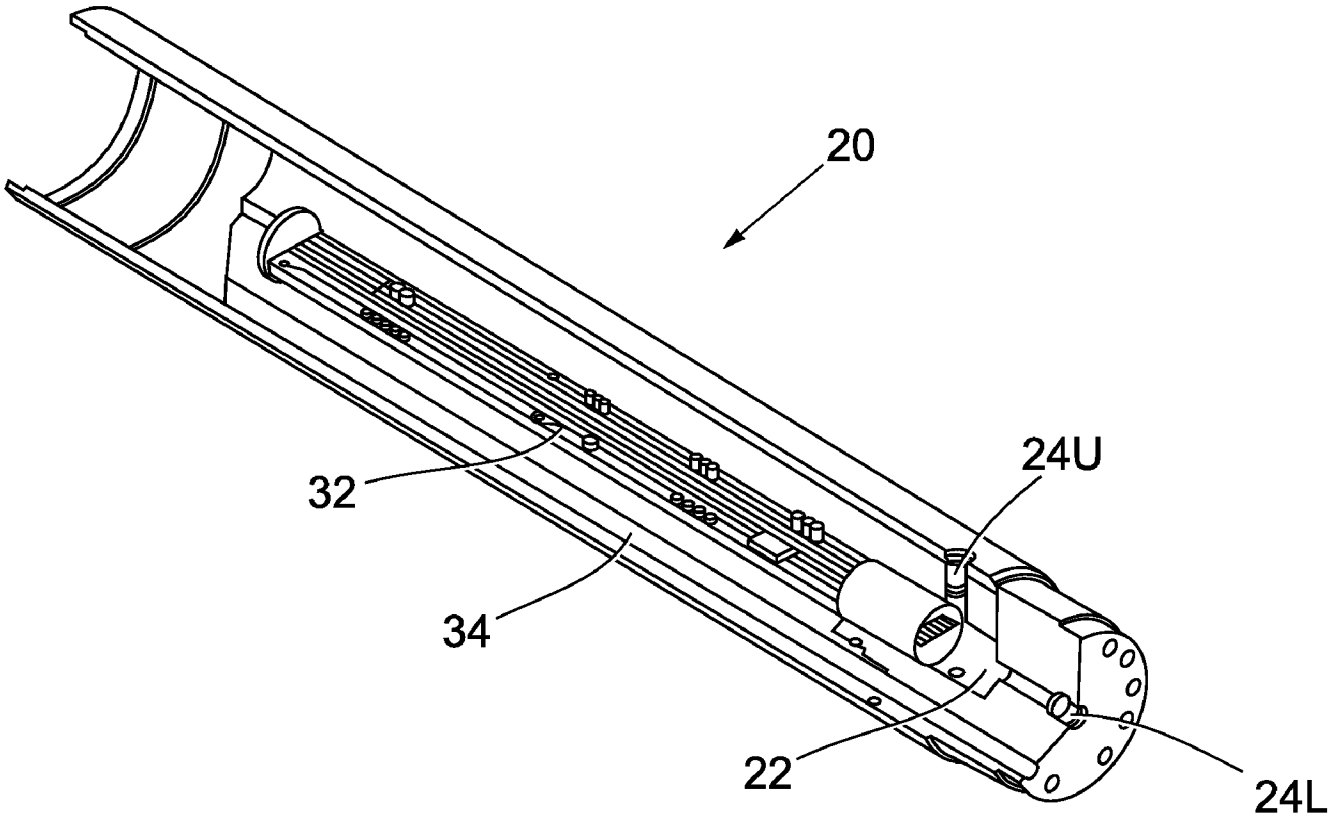
FIG. 2 is a perspective cross-sectional view of an electronics housing which forms part of the coring apparatus of FIG. 1.
Figure 3:
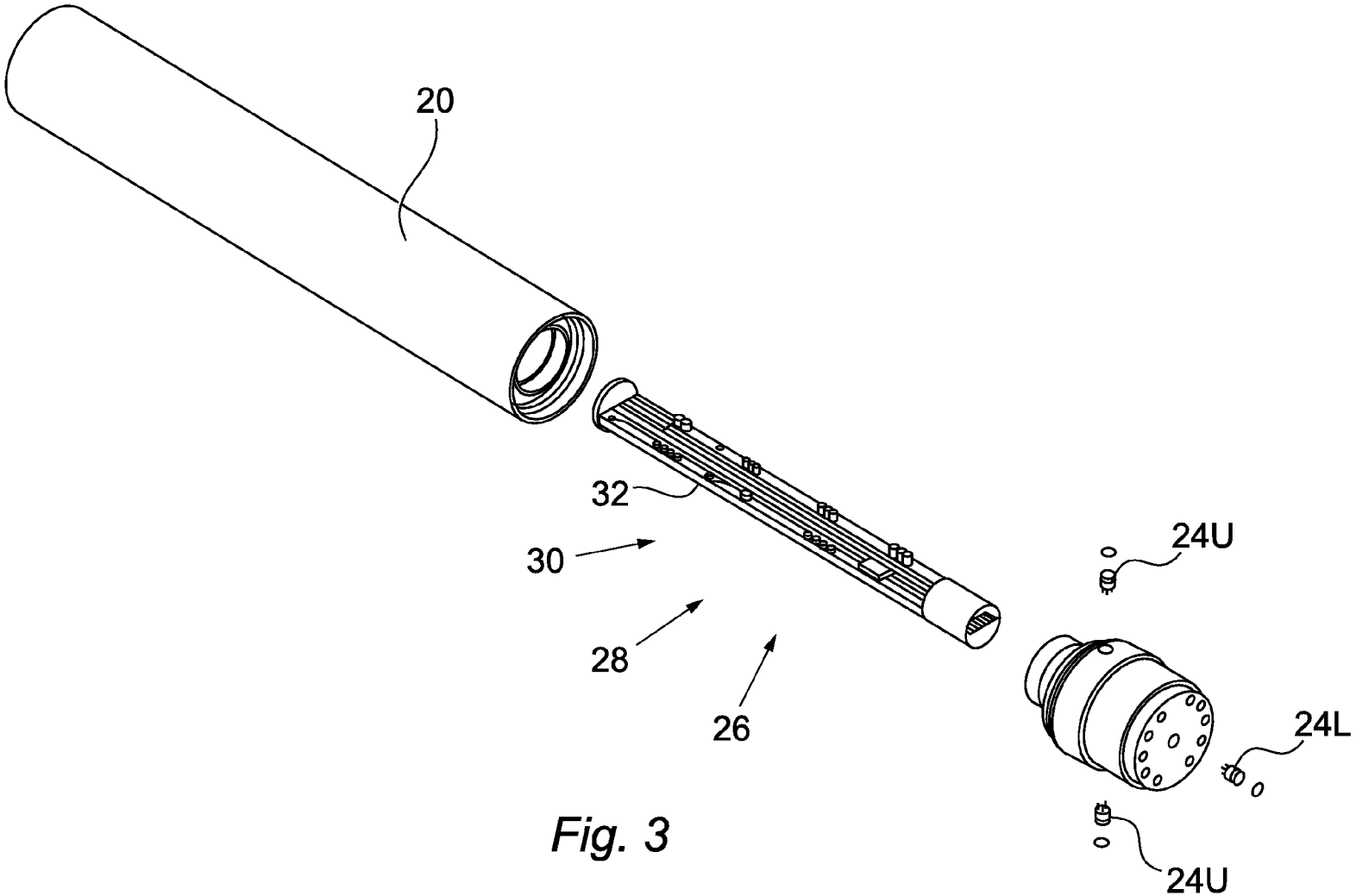
FIG. 3 is an exploded perspective view of the electronics housing, electronics board and electronics head which together make up part of the coring apparatus of FIG. 1.

Two or more pressure sensors 24L, 24U are provided with two being shown in FIGS. 1, 2 and 3. The first pressure sensor 24L is provided on the lower end of the electronics housing 20 such that the lower pressure sensor 24L senses the pressure within the inner core barrel 14. An upper pressure sensor 24U is also provided on or embedded within the sidewall of the inner core barrel 14 but is in fluid communication with the exterior of the inner core barrel 14 and senses the pressure within the outer barrel 12, but outwith the inner core barrel 14. In other words, the upper pressure sensor 24U senses the pressure in the annulus between the outer surface of the inner core barrel 14 and the inner surface of the outer core barrel 12. Accordingly, the pair of pressure sensors 24L, 24U can be used to sense any difference in pressure between the interior of the inner core barrel 14 and outside of the inner barrel 14. Consequently, when a core sample enters the inner core barrel 14, the pressure within the rest of the inner core barrel 14 will start to increase because the fluid located therein will have to be squeezed out. The pressure on the outside of the inner barrel 14 is always higher than the pressure on the inside of the inner barrel 14. As the core enters the interior 15 of the inner core barrel 14, the pressure on the inside 15 of the inner barrel 14 increases and the monitoring of the pressure fluctuation on the inside of the inner barrel 14 will provide information on the coring process. For example, if hydraulic jamming occurs (i.e. the core acting as a sealed piston on the inside of the inner barrel 14), the pressure will increase until it is able to lift the ball 25 seated at the top of the inner barrel 14. When this happens, the pressure seen by sensors 24L and 24U will be equal. As explained below, ball 25 seals off the fluid pathway via conduit 34 used to clean debris from the apparatus 10 prior to initiation of a coring operation.

Ordinarily, with no sample located in the inner core barrel 14, the pressure at sensor 24U will likely be greater than the pressure sensed by sensor 24L because of the downhole fluid pressure; as a result of the pressure drop created by the mud flow, 24U is always higher than 24L. However, if a hydraulic jam occurs in the inner core barrel 14, then the pressure sensed by the sensor 24L will increase and may become equal to the pressure sensed by the sensor 24U.

c) Rotatable Bearing Sensor

The rotatable bearing 13 is also provided with a sensor 26, the output of which is indicative of rotational movement occurring between the inner core barrel 14 and the outer core barrel 12. In other words, the rotatable bearing sensor 26 measures relative rotation occurring between the inner core barrel 14 and the outer core barrel 12. Ordinarily, when there is no core sample located within the inner barrel 14, the inner core barrel 14 will usually rotate with the outer core barrel 12 due to the presence of some level of friction in the bearing 13. However, when a core sample starts to enter the inner core barrel 14, the friction generated between the core sample and the inner surface of the inner core barrel 14 will tend to prevent rotation of the inner core barrel 14 relative to the core sample and can even stop any rotation occurring at all. Consequently, the rotatable bearing sensor 26 will see high levels of relative rotation occurring between the inner core barrel 14 and the outer core barrel 12 and therefore such high relative rotation is indicative of a core sample entering or being located within the inner core barrel 14.

Accordingly, particularly by measuring the relative rotation between the inner core barrel 14 and the outer core barrel 12, the operator will be able to tell when a jam is likely to occur because in such a situation the inner core barrel 14 will likely stop rotating completely. Accordingly, the operator will then have the opportunity to manage the coring operation in a much better way compared to conventional systems in that he will be able to change how the coring operation is conducted. For example, he could take the decision to reduce the weight on bit (WOB) or increase WOB or increase or decrease the flow rate of drilling muds that are used etc.

It is known that high rotation of the inner barrel 14 is detrimental to the core entry as it can induce jamming and also damage the core. Accordingly, being able to monitor the relative rotation will allow the operator to adapt the parameters to minimize the risk of damage to the core.

d) Vibration Sensors

One or more vibration sensors 28 are mounted on the inner core barrel 14, the output of which is indicative of any vibration being sensed in the inner core barrel 14. Vibrations are very detrimental to the coring process and to the quality of the core sample because they can damage the core sample and therefore could induce a jam occurring between the core sample and the inner core barrel 14. Furthermore, a high level of vibration might be induced by resonance and might be dampened by a change of parameters.

e) Temperature Sensor

A temperature sensor is also provided in the electronics housing 20 and is particularly included to permit the operator to calibrate the rest of the sensor readings because, for example, the pressure sensor outputs 24L, 24U will vary depending on the ambient temperature. Furthermore, it is useful for the operator to know what the downhole temperature is.

Suitable connections/wiring (not shown) is provided to connect all the aforementioned sensors to the electronics board 32.

As shown in FIG. 1, an electronics board 32 is provided to process all the data received from the sensors a) to e) described above and to transmit it using conventional data transmitting means (such as a radio transmitter (not shown)) back to the surface so that the operator can see the output from the various sensors a) to e) in real time. This provides a great advantage over the prior art systems in that the operator then has the opportunity to change the coring operation depending upon the downhole conditions as sensed by the various sensors a) to e).

Alternatively, the data transmitting means (not shown) could be omitted and instead all data could be stored on inboard memory provided on the electronics board 32 (in the same way that an airplane black box recorder operates to store data for later analysis).

FIG. 2 also shows that the electronics housing 20 is provided with a conduit 34 formed all the way longitudinally through it where the conduit 34 provides a flow path for drilling mud such that the drilling mud that is required for the cleaning of the inner barrel 14 (prior to the start of the coring operations) can pass through the electronics housing 20 without coming into contact with the electronics board 32.

Prior to the start of a coring apparatus, such as when the apparatus 10 is being run into the well, ball 25 is not in place. As a consequence, two fluid flow paths are provided in the apparatus 10 both primarily for use in a running in configuration: conduit 34 and annulus 36. Annulus 36, as shown in FIG. 1, is provided between the inner and the outer core barrel.

In the absence of ball 25, drilling mud and fluid is able to flow through annulus 36 and through conduit 34. The portion of the fluid flowing through conduit 34 can enter inside the inner core barrel 24 to clean away any debris which may have accumulated. Once cleaning of the inner core barrel is complete, ball 25 is dropped from the surface and when in position as shown in FIG. 1, closes fluid flow through conduit 34. Thus, when ball 25 is in place, as shown in FIG. 1, i.e. when cleaning is complete or during a coring operation, any mud being pumped from the surface through the coring apparatus 10, flows through the annulus 36 provided between the inner, and outer, core barrel.

Modifications and improvements may be made to the structures described herein without departing from the scope of this disclosure.

The invention claimed is:

1. A coring apparatus comprising:

an outer core barrel associated with a drill bit;

an inner core barrel adapted to accept a core sample, wherein the inner core barrel is rotatable with respect to the outer core barrel via a rotatable bearing; and a rotation sensor located within the inner core barrel, wherein the rotation sensor is adapted to measure relative rotation between the inner core barrel and the outer core barrel and output data indicative of such relative rotation and entry of a core sample into the inner core barrel, wherein the inner and outer core barrels are arranged such that, in use, relatively high levels of rotation between the inner and the outer core barrels is indicative of a core sample entering into or being located in the inner core barrel.

2. A coring apparatus as claimed in claim 1, further comprising a data transmission means to transmit the data received from the rotation sensors to an operator at the surface.

3. A coring apparatus comprising:

an outer core barrel associated with a drill bit;

an inner core barrel adapted to accept a core sample; and a vibration sensor mounted on the inner core barrel and being adapted to measure vibration experienced by the inner barrel and having a data output;

wherein the data output of the vibration sensor is indicative of any vibration being sensed in the inner core barrel.

4. A coring apparatus as claimed in claim 3, further comprising a data transmission means to transmit the data received from the vibration sensor to an operator at the surface.

5. A coring apparatus as claimed in claim 3, further comprising a data memory device to store the data output from the vibration sensor, the data memory device providing information on the downhole conditions experienced when the core sample was obtained.

* * * * *